United States Patent [19]

Kim

[11] Patent Number: 4,743,012

[45] Date of Patent: May 10, 1988

[54] BICYCLE EXERCISING DEVICE

[76] Inventor: Yong N. Kim, 18 Wellington Rd., Greenvale, N.Y. 11548

[21] Appl. No.: 76,941

[22] Filed: Jul. 23, 1987

[51] Int. Cl.[4] ..... A63B 69/16; G09B 9/04

[52] U.S. Cl. ..... 272/73; 434/61

[58] Field of Search ..... 272/73, 72, 97, 93, 272/146, 114, 52, 52.5, 53.1, 54, 56, 69; 128/25 R; 180/224; 434/61

[56] References Cited

U.S. PATENT DOCUMENTS

| | | | |
|---|---|---|---|
| 589,705 | 9/1897 | Dwyer | 272/73 |
| 4,415,152 | 11/1983 | Smith | 272/73 |
| 4,580,983 | 4/1986 | Cassini et al. | 272/73 |

*Primary Examiner*—Richard J. Apley
*Assistant Examiner*—S. R. Crow
*Attorney, Agent, or Firm*—Charles E. Temko

[57] ABSTRACT

A bicycle type exerciser in which a more realistic sensation to the rider is imparted is disclosed. As contrasted with prior art devices, the frame of the device is arranged for pivoting motion in a lateral direction in response to a turning motion imparted to the handlebars. A steerable front wheel is supported by a conventional front fork. The rear of the frame is supported by a transversely extending arcuately-shaped rocker which rests upon a floor or other horizontal supporting surface. As the handlebars are turned, the frame is leaned to one side or the other by the rider simulating the riding of a bicycle.

6 Claims, 4 Drawing Sheets

BICYCLE EXERCISING DEVICE

BACKGROUND OF THE INVENTION

This invention relates generally to the field of exercising devices, and more particularly to an improved bicycle simulating type which remains stationary when in use. Devices of this general type are known in the art, and the invention lies in specific constructional details which permit improved realism while riding the same.

In U.S. Pat. No. 4,148,478 granted Apr. 10, 1979 to Moysky, et al., there is disclosed a typical prior art exercising device of this type. In this construction, a fixed frame supports a saddle and a crank. The rear of the frame mounts a transversely extending member which is supported by a floor. At the front of the frame a stem supports a fixed front wheel fork, the lower end of which mounts a second transversely-extending support which engages the floor. The crank drives a front wheel supported by the fork which turns freely, except for friction drag means.

While such devices provide adequate exercise, the user does not have the feeling of riding a bicycle, since he cannot steer and experiences no lateral leaning motion associated with a steering maneuver.

U.S. Pat. No. 4,415,152 granted Nov. 15, 1983 to Smith provides such a feeling to the rider by employing an actual bicycle supported on a beltway supported by rollers upon which the front wheel rests. The rear wheel straddles a pair of transversely extending rollers. Vertical supports interconnect flexible chains or cables to limit the degree of lateral tilting of the frame. The front wheel is steerable within the limits of the width of the beltway. An optional inclinometer is also provided to indicate the degree of tilting movement.

While the above described structure achieves a desired result, the cost of fabricating such structure, including a complete bicycle, is very high, as a result of which public acceptance of this structure has been of a very low order.

SUMMARY OF THE INVENTION

Briefly stated, the invention contemplates the provision of an improved bicycle type exercising device capable of creating a realistic sensation to a rider which may be manufactured at a reasonably low cost, with corresponding wide acceptance on the part of the purchasing public.

To this end, there is provided a simplified structure including a longitudinally extending frame, the forward part of which resembles a conventional bicycle, and includes a steerable front wheel which rests upon a transversely extending roller, the roller, in turn, being supported upon a floor. The rear end of the frame is modified to include a vertical shaft-like support, the lower end of which engages a transversely-extending, arcuately-shaped rocker which rests upon the floor. When the device is used, the front wheel may be steered to result in a traversing movement of the wheel over the surface of the roller accompanied by a lateral pivoting of the frame to one side or the other as the rear end of the frame tilts on the rocker. A conventional foot-powered crank may drive a front wheel on the roller, or a rear sprocket or equivalent device which creates resistance to pedal movement.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENTS

Figure 1:
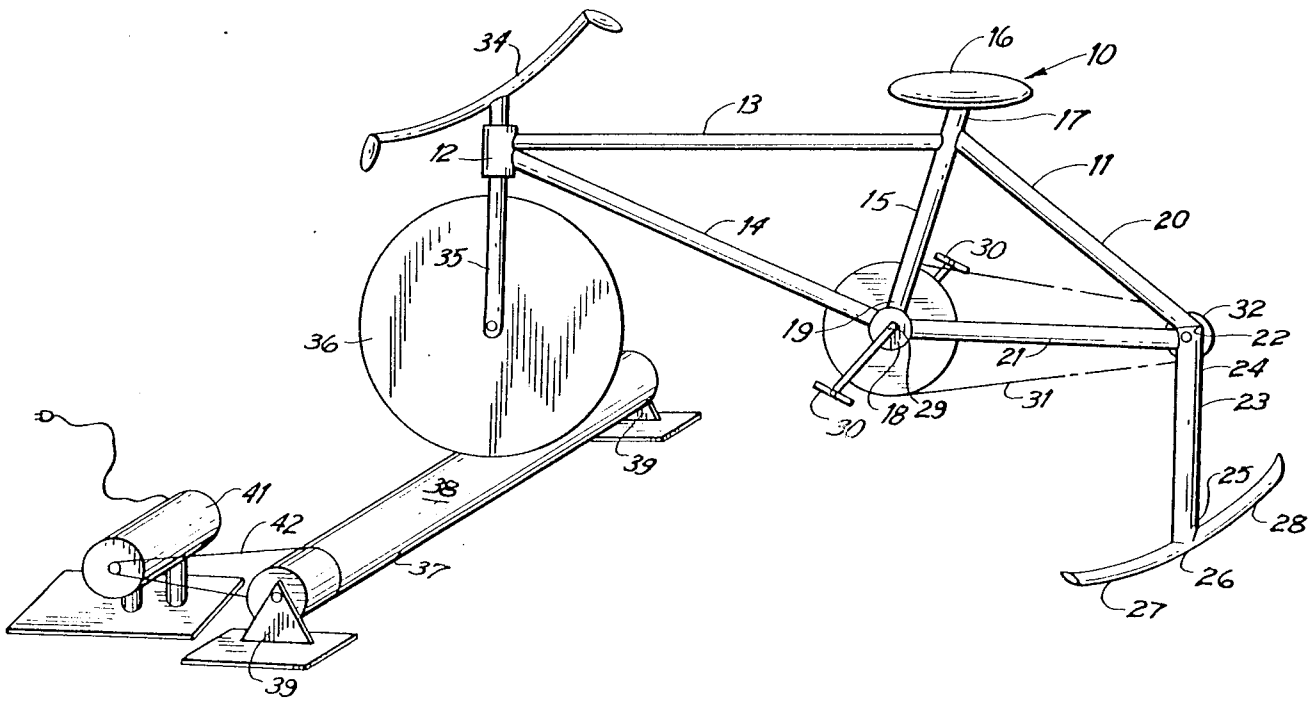
FIG. 1 is a schematic perspective view of a first embodiment of the invention.

In accordance with the invention, the first embodiment, generally indicated by reference character 10 (FIG. 1) comprises a generally conventional frame 11 including a front stem 12, an upper horizontal member 13, a lower horizontal member 14, a vertical member 15 having a saddle 16, at upper end 17 thereof; and a crank hanger 18 at a lower end 19 thereof.

Extending rearwardly of the vertical member 15 are upper and lower rear members 20 and 21 interconnected at point 22. A vertical support member 23 extends downwardly from the point 22 from an upper end 24 to a lower end 25 where it interconnects with a transversely extending member 26 of arcuate configuration including left and right-hand portions 27 and 28, respectively.

A generally conventional crank member 29 supports pedals 30. A sprocket chain 31 transmits motion to a rear sprocket 32 which includes conventional adjustable resistance means (not shown).

The front stem 12 underlies conventional handlebars 34 which penetrate the same to interconnect with the upper end of a front fork 35 supporting a front wheel 36. Positioned beneath the wheel 36 and supported by a floor is a transversely-extending roller 37 an outer surface 38 of which supports the wheel 36 and rotates therewith. The roller 37 is supported at each end by a pair of rotational supports 39 which, in turn, rest upon a floor. An electric motor 41 powers a belt 42 which passes over the surface 38 to impart motion to the roller 37.

During use, the rider will impart motion to the pedals 30 which motion is frictionally resisted by the sprocket 32 in a manner known in the art. The motor 41 drives the roller 37 in turn causing the front wheel 36 to axially rotate. The user may simulate a turn by turning the handlebars in desired direction, and leaning in the direction of the turn, at which time the rocker 26 will execute a rocking motion over the floor. If desired, additional realism may be obtained by providing a switch (not shown) which interrupts the passage of current to the motor 41 when the crank is not rotated.

Figure 2:
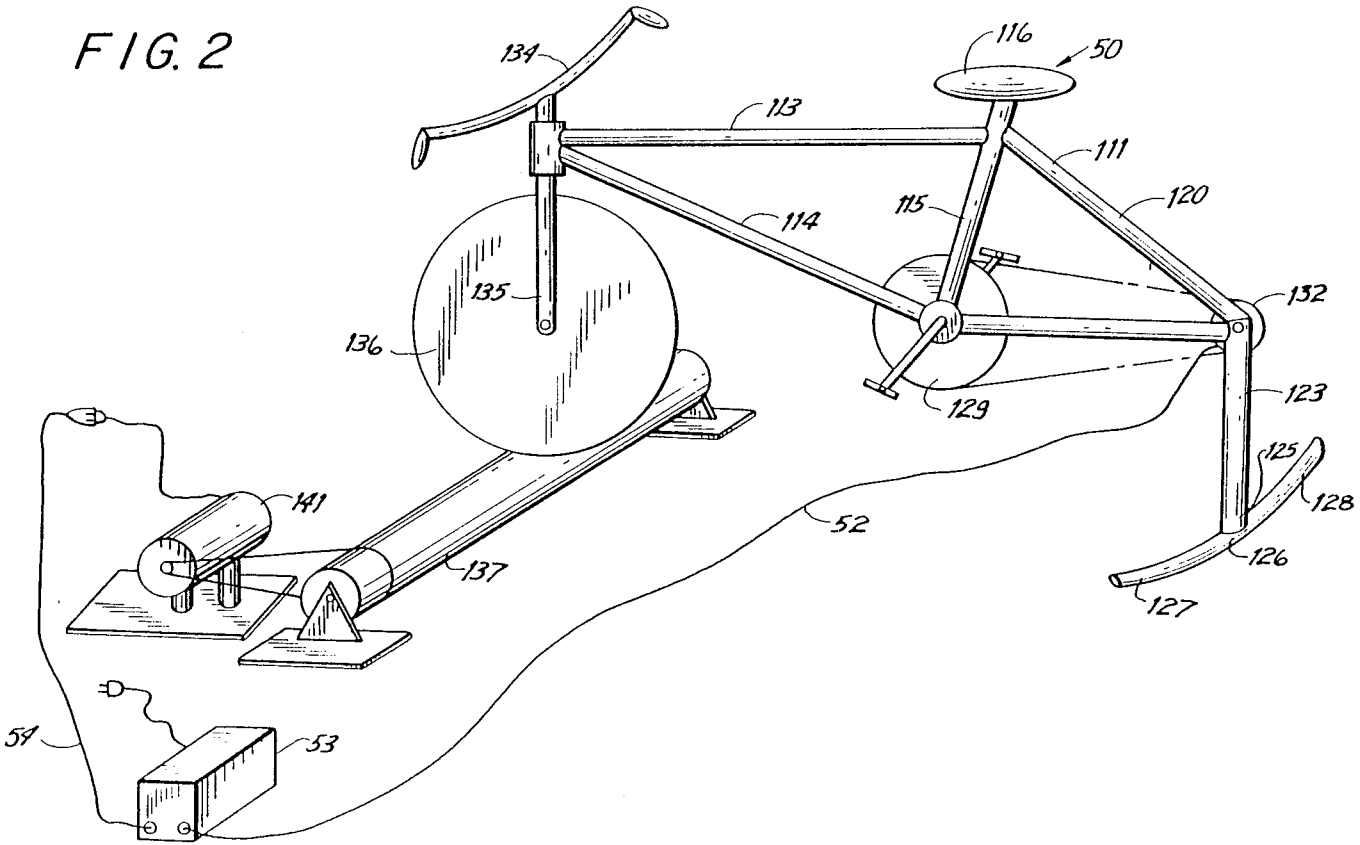
FIG. 2 is a similar schematic perspective view of a second embodiment of the invention.
Figure 3:
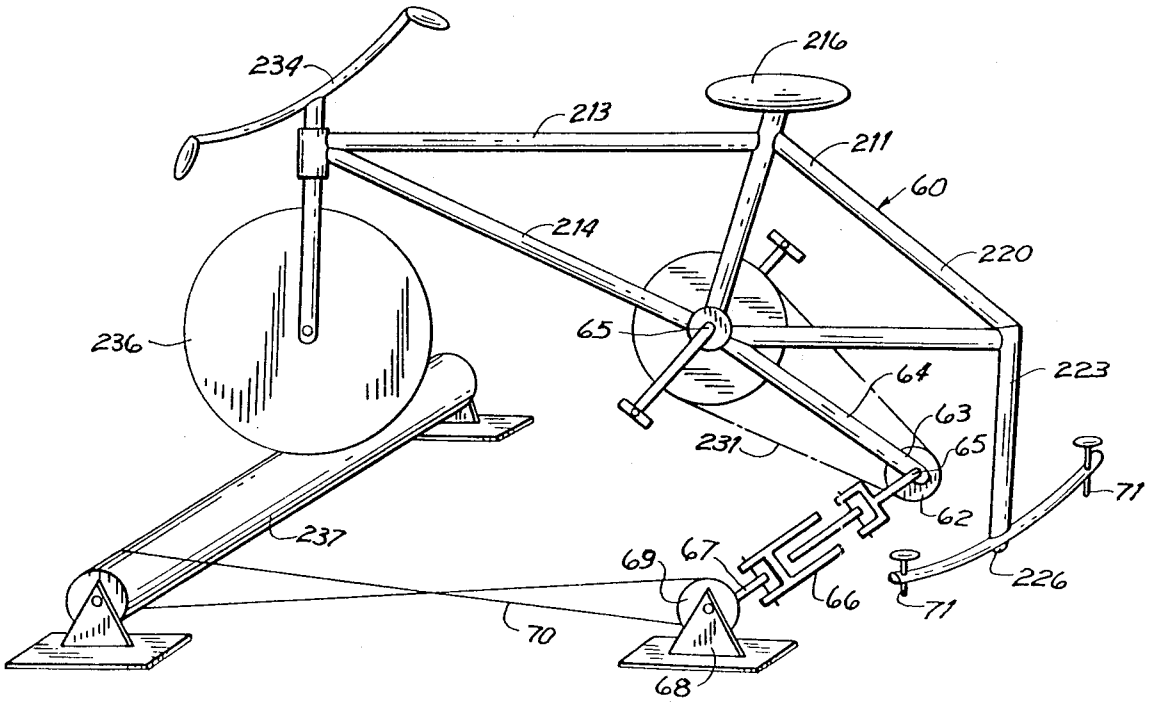
FIG. 3 is a schematic perspective view of a third embodiment.

Turning now to the second embodiment of the invention, generally indicated by reference character 50 (FIG. 2), to avoid needless repitition, certain of the parts corresponding to those of the first embodiment have been designed by similar reference characters with the additional prefix "1".

The second embodiment differs from the first embodiment principally in the provision of means to relate driven rotation of the roller 137 to movement of the crank 129. To this end, the rear sprocket 132 is provided with electric signal generating means (not shown), i.e. a small DC generator, which provides a signal conducted over conductor 52 to a power amplifier 53, the output of which travels over a second conductor 54 to the motor 141. During operation, the faster the crank is turned, the greater amplitude will be the signal generated by the signal generator, and the greater the amplification which powers the motor 141.

Turning now to the third embodiment of the invention, generally indicated by reference character 60, certain of the parts corresponding to the first embodiment have been designated by similar reference characters with the additional prefix "2".

In this embodiment, the sprocket chain 231 is entrained upon a sprocket 62 supported at a lower end 63 of a downwardly sloping frame member 64. The sprocket is mounted on a dirven shaft 65 which includes universal joints 66. An opposite end 67 of the shaft is journaled in a support 68 which rests upon the floor. The end 67 also mounts a pulley 69 which entrains a flexible belt 70, an opposite end being entrained on the roller 37. In this embodiment, leveling means in the form of thumb screws 71 are positioned at the end of the rocker 226 to prevent undue tilting motions which might adversely affect the operation of the joint 66.

Figure 4:
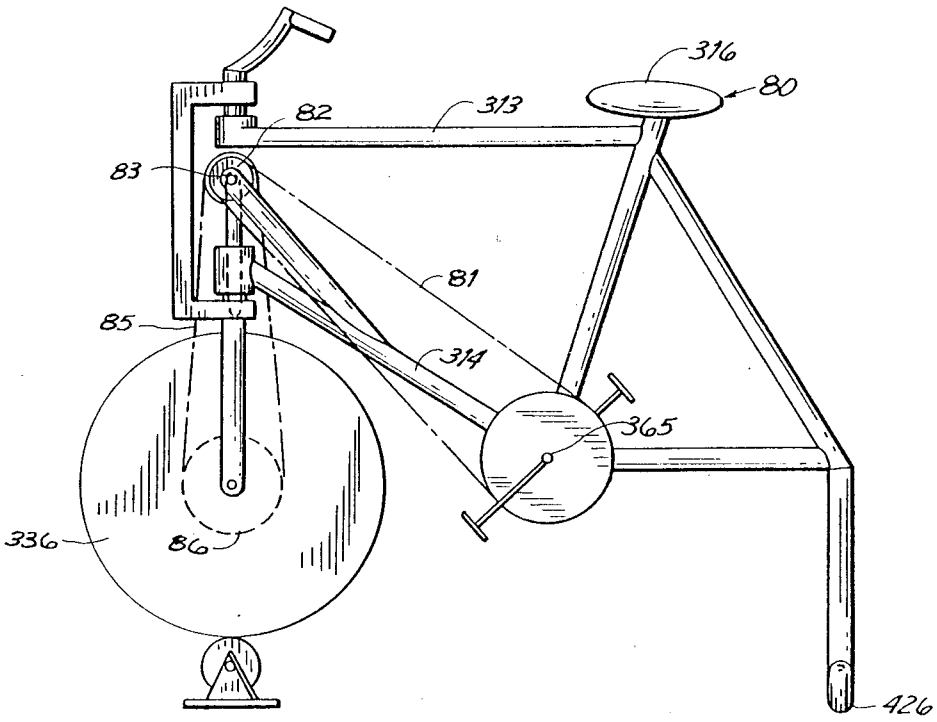
FIG. 4 is a schematic perspective view of a fourth embodiment.

Turning now to the fourth embodiment of the invention, generally indicated by reference character 80 (FIG. 4), certain of the parts corresponding to those of the first embodiment have been designated by reference characters with the additional prefix "3".

In the fourth embodiment, a first sprocket chain 81 drives a sprocket 82 on a transversely oriented shaft 83 positioned with a truncated stem 84. The shaft 83 includes a universal joint, the output section of which drives a second sprocket chain 85 interconnected to a driven sprocket 86 on the front wheel 336. This structural arrangement is similar to that disclosed in U.S. Pat. No. 3,045,772, granted July 14, 1962 to Nicolai. The same result may be accomplished using the teachings of Nicolai U.S. Pat. No. 3,024,860 of Mar. 13, 1962 or the Bowman U.S. Pat. No. 3,118,514 of June 21, 1964.

It may thus be seen that I have invented novel and highly useful improvements in bicycle exercising devices, in which, without the addition of major components, it is possible to simulate the sensation and feel of riding an actual bicycle, while the device remains stationary. As the rider pedals, he may execute steering maneuvers to either side, leaning the frame of the device much as would be done in the case of riding a conventional bicycle.

I wish it to be understood that I do not consider the invention limited to the precise details of structure shown and set forth in this specification, for obvious modifications will occur to those skilled in the art to which the invention pertains.

I claim:

1. An improved bicycle type exercising device comprising: a longitudinally oriented frame having front and rear ends, rider supporting means positioned medially of said ends, crank means carried by said frame positioned to be powered by a rider, said frame including a verticlaly oriented stem at said front end thereof, a fork carried by said stem and extending downwardly therefrom, a front wheel carried by said fork, handlebars carried by said fork at an upper end thereof for transmitting a steering motion to said front wheel, a transversely extending elongated roller positioned beneath and engaging said front wheel for rotation therewith, and means for imparting motion to said roller and front wheel; said rear end of said frame having a downwardly extending member and an arcuately shaped transversely oriented rocker having a medial portion interconnected to a lower end of said downwardly extending member, said rocker being adapted to engage a horizontal supporting surface; whereby, during the riding of said device, motion imparted to said handlebars results in said front wheel traversing the length of said roller, said rocker pivoting to permit tilting of said frame in the transverse direction.

2. An exercising device in accordance with claim 1, further characterized in the provision of electric motor means powering said roller.

3. An exercising device in accordance with claim 2, further characterized in the provision of signal-generating means powered by said crank, means for amplifying the output of said signal generating means, said electric motor means being powered by the output of said amplifying means in a manner corresponding to rotation of said crank.

4. An exercising device in accordance with claim 1, further characterized in the provision of a driven sprocket driven by said crank, a transversely-extending driven shaft carrying said driven sprocket at a first end thereof, a pulley carried by said driven shaft at an opposite end thereof, and a flexible belt carried by said pulley and transmitting motion to said roller.

5. An exercising device in accordance with claim 4, further characterized in said driven shaft including a universal joint medially positioned between said first and opposite ends thereof.

6. An exercising device in accordance with claim 1, further characterized in said crank having means for imparting axial motion to said front wheel.

* * * * *